US005771529A

United States Patent [19]

Brule et al.

[11] Patent Number: 5,771,529

[45] Date of Patent: Jun. 30, 1998

[54] CONNECTION DEVICE BETWEEN A VACUUM CLEANER AND A SUCTION PIPE

[75] Inventors: François Brule, Pacy-sur-Eure; Pierre Kerboas, Chambray, both of France

[73] Assignee: SEB S.A., Ecully, France

[21] Appl. No.: 648,193

[22] PCT Filed: Dec. 2, 1994

[86] PCT No.: PCT/FR94/01410

§ 371 Date: Jun. 3, 1996

§ 102(e) Date: Jun. 3, 1996

[87] PCT Pub. No.: WO95/15109

PCT Pub. Date: Jun. 8, 1995

[30] Foreign Application Priority Data

Dec. 3, 1993 [FR] France ..... 93 14757

[51] Int. Cl.[6] ..... A47L 9/14

[52] U.S. Cl. ..... 15/339; 15/347; 55/367

[58] Field of Search ..... 15/339, 347, 350; 55/367, 374

[56] References Cited

U.S. PATENT DOCUMENTS

| | | | |
|---|---|---|---|
| 2,804,167 | 8/1957 | Seck | 55/367 |
| 3,335,744 | 8/1967 | Hanford . | |
| 3,667,084 | 6/1972 | Valbona et al. | 15/350 X |
| 4,715,084 | 12/1987 | Jacob et al. | 15/350 X |
| 5,111,841 | 5/1992 | Houston et al. . | |
| 5,468,272 | 11/1995 | Schmierer | 55/367 |

FOREIGN PATENT DOCUMENTS

| | | |
|---|---|---|
| WO 89/12493 | 12/1989 | European Pat. Off. . |
| 932 776 | 4/1948 | France . |
| 324809 | 10/1957 | Germany . |
| 449815 | 7/1936 | United Kingdom . |

*Primary Examiner*—Chris K. Moore
*Attorney, Agent, or Firm*—Pillsbury Madison & Sutro

[57] ABSTRACT

A connection device between a suction pipe and a vacuum cleaning unit, the unit having a closing flap (5) displaceable between an open position and a closed position at the suction inlet of the unit by using a control member (11) as well as a component for locking the nozzle (20) to the suction unit. The suction unit is a vacuum cleaner having a dust bag (1), the closing flap (5) being arranged on the bag (1), and a control member (11) cooperating with the nozzle (20) by means of a cooperation device so that the locking of the nozzle (20) is possible as soon as the flap (5) is in its open position. Application to vacuum cleaners with disposable bags.

11 Claims, 4 Drawing Sheets

CONNECTION DEVICE BETWEEN A VACUUM CLEANER AND A SUCTION PIPE

TECHNICAL FIELD

The present invention relates to a connection device between a suction pipe, of the flexible type, and a mobile vacuum cleaner unit.

The present invention concerns a device for closing and ejecting a disposable bag of a vacuum cleaner, the bag being fixed, during a cleaning operation on a part of the housing of said vacuum cleaner.

The invention is applied in a general manner to any mobile vacuuming unit of the vacuum cleaner type, which is displaceable by the user in a zone to be cleaned and comprises a bag for trapping dust, being removable and disposable.

PRIOR ART

The state of the prior art in this field is constituted, for example, by U.S. Pat. No. 3,335,744, which describes a fixed, central vacuum cleaning system, connected to a suction pipe. The vacuuming system comprises a blocking valve arranged on a suction opening and elastically retractable during introduction of the suction pipe. The system thus described concerns a central installation associated with an assembly of suction conduits distributed in the floors and/or the walls of the building.

It is equally known to provide blocking means for bags, for example by the intermediary of French Document A-932,776, which describes a bag furnished with a closing means. This latter pivots between an opening position and a closing position of the filling opening of the bag, with the aid of a mechanical system constituted by a pivot axis, an elastic restoring means as well as a part serving as an abutment for the closing means, arranged on a rigid plate of the bag. Such a system presents a group of inconveniences and notably, in its construction, for which a number of distinct and substantial pieces are necessary, thus generating a high fabrication cost.

In addition, the arrangement of the system and more particularly of the closing means on the rigid plate, in an accessible manner, weakens said system, and the particular configuration of the closing means does not permit simple and/or automatic operation thereof with an independent control member.

The object of the present invention is to remedy the inconveniences of the prior art and to achieve in a simple manner, which is inexpensive and easy to utilize, a vacuum cleaner whose suction pipe connection system functions in an optimal manner in association with a closing means of the bag for trapping dust.

The object of the present invention consists in furnishing a closing device for the vacuum cleaner bag which the user can manipulate without entering into direct contact with said bag during the closing operation.

Another object of the present invention is to furnish the user of vacuum cleaners with a simple and nonrestricting device for ejecting said bag from the housing of the vacuum cleaner.

Another object of the invention consists in utilizing a means for closing the vacuum cleaner bag which occupies a limited space, is easily fabricated, is inexpensive and can be disposed in an opening or closing position at the will of the user.

Another object of the invention is to furnish a safety device intended to prevent fixation of the suction pipe on the housing of the vacuum cleaner when the bag is closed.

A supplementary object of the invention is to furnish an automatic closing device for vacuum cleaner bags.

SUMMARY OF THE INVENTION

The objects of the present invention are achieved with the aid of a device for connection between a suction pipe and a vacuum cleaning unit, constituted by an attachment nozzle forming the extremity of the suction pipe mounted in communication with the vacuum cleaning unit, which comprises a closing flap displaceable between an opening position and a closing position of the suction inlet of said unit, with the aid of a control member as well as means for locking the nozzle on the vacuum cleaning unit, characterized in that the vacuum cleaning unit is a mobile vacuum cleaner comprising a housing in which is disposed a removable bag, serving as a dust recovery container, the closing flap being disposed on the bag, and the control member cooperating with the duct with the aid of cooperation means, in such a manner that the locking of the duct on the housing with the aid of the locking means is possible when the closing flap is in its opening position.

BRIEF DESCRIPTION OF THE DRAWINGS

Other particularities and advantages of the invention will appear and become apparent in greater detail from a reading of the description presented herebelow, with reference to the attached drawings given by way of illustrative and nonlimiting examples in which.

BEST MANNER OF PRACTICING THE INVENTION

Figure 1:
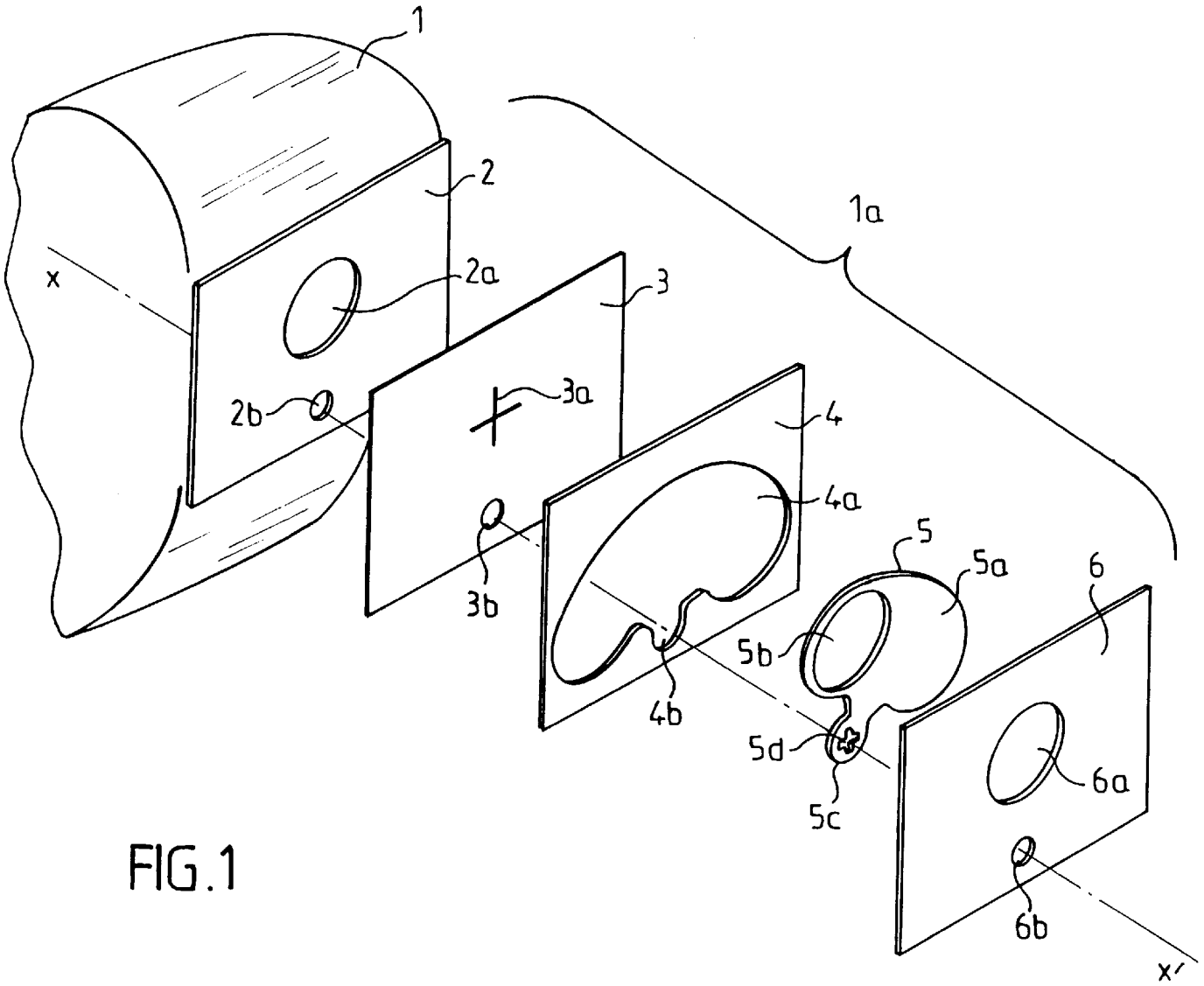
FIG. 1 represents an exploded view of the vacuum cleaner bag on which is arranged a closing means according to the invention.

FIG. 1 represents a disposable vacuum cleaner dust bag 1 comprising a rigid zone 1*a*, which contains a closing means of said dust bag 1, as well as the arrangement of this means on said dust bag 1. The rigid zone 1*a*, made for example of plastic or cardboard material, is constituted particularly by a guiding means 4 and a flap 5 for closing and opening dust bag 1. The guiding means 4 is made of a rigid material, for example cardboard, which comprises a shaped perforation 4*a* for guiding the opening and closing flap 5 at the filling opening of dust bag 1. The closing flap 5 is mounted in the rigid zone 1*a*, which is provided with the shaped perforation 4*a* whose form and contour provide the guiding means 4 in which closing flap 5 is displaced.

The shaped perforation 4*a*, arranged in the guiding means 4, presents a form of an ear associated with a recess 4*b*, the closing flap 5 partially mating by its form the shaped perforation 4*a* and presenting a surface below the shaped perforation 4*a* to permit rotation of said closing flap 5, which is driven by a driving means 10 fixed to a tongue 5*c* associated with the flap 5 whose form corresponds to the recess 4*b*. This latter thus serves as a housing for the tongue 5*c*, in a manner to be able to turn in the recess 4*b* and thus create a rotation axis for the flap 5. The shaped perforation 4*a* is thus presented in the form of a virtual ear. The closing flap 5, partially mating by its shape the shaped perforation 4*a*, also presents a form of an ear constituted by a solid lobe 5*a* and a perforated lobe 5*b*. The solid lobe 5*a* and the perforated lobe 5*b* are attached to the tongue 5*c* in a manner such that this latter can fulfill the role of a pivoting shaft. The tongue 5*c* is preferably centered on a median line or a line of symmetry, not shown in the figures, of the ear representing the solid lobe 5*a* and the perforated lobe 5*b*. The recess 4*b* is thus equally centered on a median line or a line of symmetry, not shown in the figures, of the virtual ear defined by the shaped perforation 4*a*. The pivot shaft thus realized by the tongue 5*c* is centered on an axis x—x' schematizing also the axis of assembly of the different pieces constituting the rigid zone of the bag 1. The recess 4*b* is also centered on the axis x—x'. Advantageously the tongue 5*c*, the solid lobe 5*a* and the perforated lobe 5*b* are made in one piece, which is obtained for example by cutting a cardboard sheet.

Flap 5 is housed in the shaped perforation 4*a* and the combined forms, of the shaped perforation 4*a* associated with the recess 4*b* and the flap 5 associated with the tongue 5*c*, permit said flap 5 to be movable by rotation in the guiding means 4 between an opening position and a closing position of the filling bag 1. The form and the contour of the shaped perforation 4*a*, associated with the configuration of the flap 5 in the form of an ear, permits said flap to be guided along the length of its trajectory, extending between an opening and a closing position of the filling inlet of bag 1. The shaped perforation 4*a* and/or the recess 4*b* are equally utilized as end abutments against which the flap 5 comes to year in one or the other of its opening or closing position. According to another embodiment of the device according to the invention, the flap 5 is constituted by a single solid lobe 5*a* associated with the tongue 5*c*. The closing flap 5 covers a part of the surface of the shaped perforation 4*a*, in a manner to permit said closing flap 5 to be displaced in said shaped perforation 4*a*. Thus in the opening position of bag 1, the perforated lobe 5*b* faces the filling opening of the bag 1 and in the closing position of the flap 5, the solid lobe 5*a* faces the filling inlet of the bag 1.

The rigid zone 1*a* of the bag 1 is constituted by an assemblage forming a sandwich structure including a fastening plate 2 secured to the bag 1 and provided with an orifice 2*a*, the guiding means 4 presenting the shaped perforation 4*a* in which is housed the closing flap 5 as well as a rigid front sheet 6 in which is arranged an opening 6*a* in a manner to hold the closing flap 5 in the shaped perforation 4*a*. The rigid zone 1*a*, constituted by plates or layers assembled successively permits attaining a rigidity and an optimal flexibility for attaching or detaching the bag 1 from the housing of the vacuum cleaner. The fastening plate 2, preferably made of a rigid material constitutes with the orifice 2*a* the filling opening of the bag 1. Such a preferred embodiment renders the rigid zone 1*a* and in particular the closing device, particularly solid and resistance to shocks. There does not exist in effect any possibility of gaining access to the flap 5 in a manner to twist it or deform it in an undesired manner. Advantageously, the flap 5 is produced starting from the guiding means 4 by utilizing a portion of the material removed by any known means from said guiding means 4, during the formation of the shaped perforation 4*a*. The closing flap 5 is then cut in a manner to be movable by rotation in the shaped perforation 4*a* and to dispose in front of the orifice 2*a* the perforated lobe 5*b* or the solid lobe 5*a* in order to respectively open or close access to the bag 1. The rigid front sheet 6 comprises an opening 6*a* centered on the orifice 2*a*. The rigid front sheet 6 is for example cemented or stapled to the fastening plate 2 in a manner to secure the entirety of the rigid zone 1*a* with the bag 1. The utilization of any other means for fastening the rigid front sheet 6 on the fastening plate 2 is envisionable.

Preferentially, the thickness of flap 5 is slightly less than the thickness of guiding means 4 in a manner to facilitate its rotation in the free space delimited by the fastening plate 2, the rigid front sheet 6 as well as by a surface defined by the thickness of the guiding means 4 and the contour of the shaped perforation 4*a*.

Advantageously, the rigid zone la comprises a waterproof membrane 3 in which a hole 3*a* is formed. The waterproof membrane 3 is disposed between the fastening plate 2 and the guiding means 4. The hole 3*a* is preferably formed by two perpendicular incisions centered on the orifice 2*a*, on the opening 6*a* and on the perforated lobe 5*b* when the flap 5 is in the opening position of bag 1. The utilization of a waterproof membrane 3 is particularly advantageous for taking up play and consequently scaling defects when a suction pipe is in communication with the bag I through the orifice 2*a*. The fastening plate 2, the waterproof membrane 3 and the rigid front sheet 6 present respectively a hole 2*b*, 3*b* and 6*b* which permit the driving means 10, which is fixed to the 5*c*, to traverse this latter and to transmit thereto a rotation movement.

The driving means 10 is controlled by a control member 11 operated from outside of the vacuum cleaner housing 13, said driving means 10 being fixed to the tongue 5*c* by the intermediary of a notch 5*d* formed in said tongue 5*c*. The housing 13 constitutes, of course, an enclosure and an external envelope of a vacuum assembly comprising particularly suction organs of the motor/ventilator type. In an advantageous manner, the notch 5*d* could be replaced by two perpendicular crossed notches. The driving means 10 presents a form complementary with the notch 5*d*. The overall arrangement, constituted by the fastening plate 2, the waterproof membrane 3, the guiding means 4, the flap 5 and the rigid front sheet 6, represented in FIG. 1, thus constitute the rigid zone of the bag 1.

The control member 11 is mounted to be movable in translation above the rigid zone la to exert a deformation on said rigid zone 1*a* permitting detachment of the bag 1 from the housing 13 of the vacuum cleaner. The rigid zone 1*a* has a flexibility sufficient to be disengaged from an edge 14 and a slot 14*b* when the user exerts a pressure on the control member 11. Advantageously, the control member 11 comes into an initial position by translation after the ejection of bag 1 by the intermediary of a spring I l*a* arranged in said control member 11.

Figure 2:
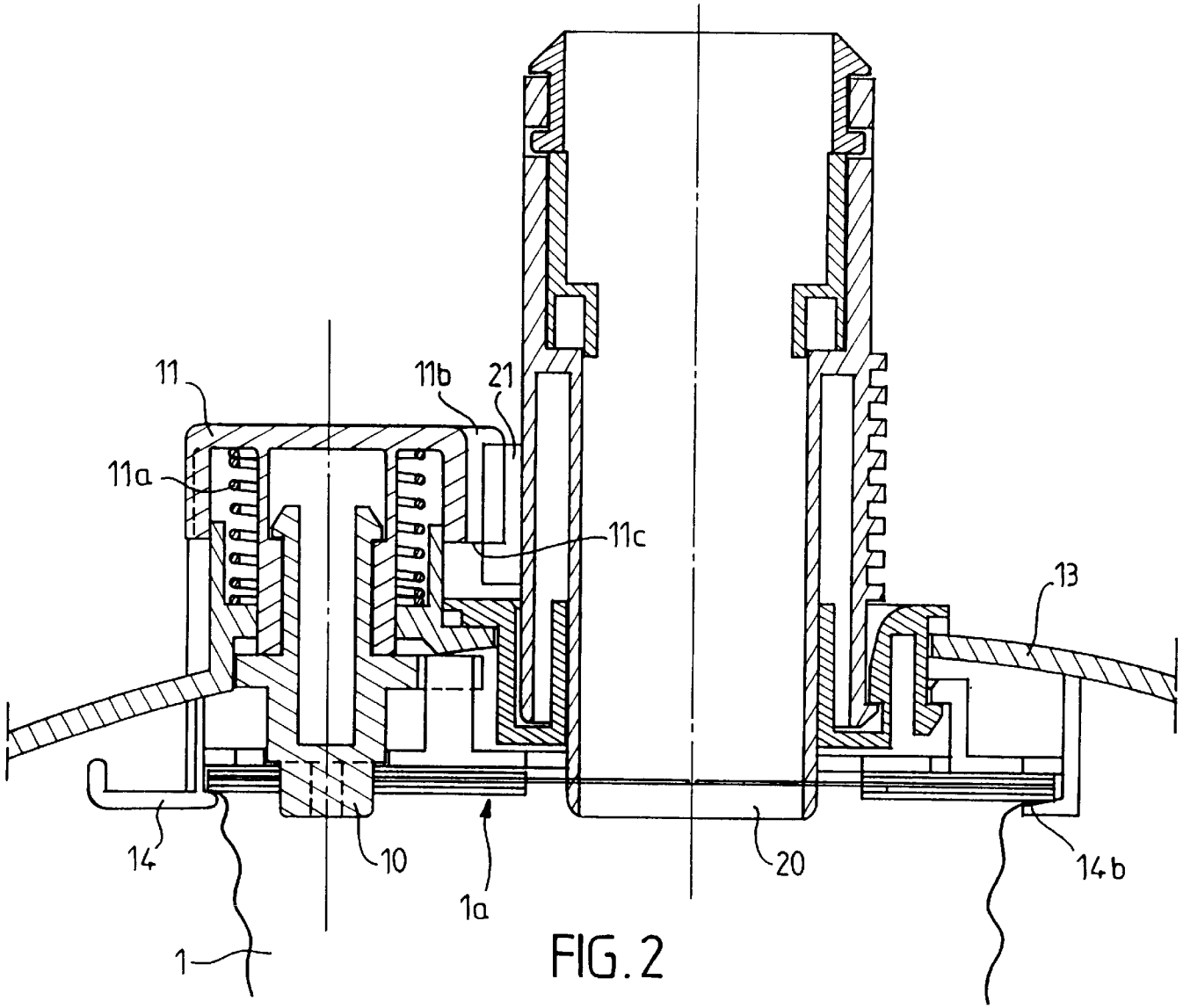
FIG. 2 represents a partial cross-sectional view of the housing of the vacuum cleaner on which is arranged a control member and the extremity of the pipe of said vacuum cleaner according to the invention.

FIG. 2 represents a device for connection between a suction pipe and a dust recovery bag I arranged on the housing 13 of a vacuum cleaner, said device comprising a fastening nozzle 20 forming the extremity of the suction pipe, means for locking the nozzle 20 on the housing 13 as well as the flap 5 for closing bag 1 displaceable between an opening position and a closing position of the filling bag 1. The device comprises a control member 11, and cooperation means arranged on the control member 11 and on the nozzle 20 to cooperate when the closing flap 5 is in the opening position and to thus permit locking of the nozzle 20 on the housing 13. The cooperation means are for example constituted by means of the male/female type. Preferentially, the device comprises a male means arranged on the nozzle 20 and a female means arranged on the control member 11. According to a variant of the device according to the invention, this latter comprises a male means arranged on the control member 11 and a female means arranged on the nozzle 20.

In an advantageous manner, the cooperation means are constituted by a lug 21 arranged on the nozzle 20 and an opening 11*b* arranged in a part of the control member 11, said lug 21 lodging in the opening 11*b* during the locking operation. The locking of the nozzle 20 on the housing 13 can only be obtained when the lug 21 is introduced into the opening 11*b* or passes through the opening 11*b*. Such a cooperation is only possible when the control member 11, which is movable by rotation, is found in a well determined angular position. This latter corresponds to the opening position of the closing means of the bag 1. A rotation of the control member 11 corresponds to a rotation of the driving means 10 which is mechanically fixed to the control member 11.

Advantageously, the nozzle 20 is connected to a flexible pipe constituting the vacuum cleaner pipe which is freely rotatable with respect to the nozzle 20 by the intermediary of any known means. Thus, the user of the vacuum cleaner is not in any way inconvenienced by the fixed locking of the nozzle 20 on the housing 13. The control member 11 is thus mounted to be made mobile by rotation in order to close or open the bag 1 on the one hand and by translation in order to disconnect the bag I from the housing 13.

According to another embodiment of the connection device according to the invention, the means for cooperation between the nozzle 20 and the control member 11 are provided directly by the closing flap 5, in impeding the locking operation of the nozzle 20. This latter comes to abut against the closing flap 5 when this latter is in the position for closing the bag 1.

Figure 3:
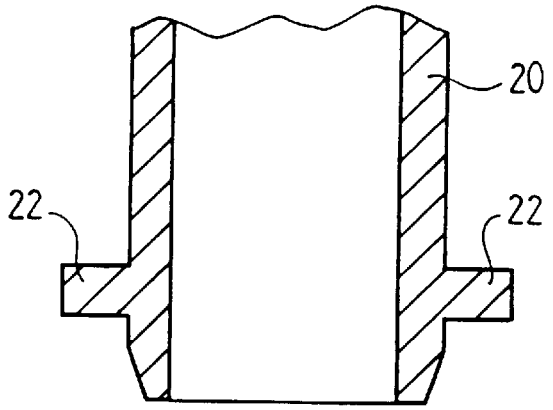
FIG. 3 represents a partial cross-sectional view of the vacuum cleaner pipe nozzle according to the invention.
Figure 3A:
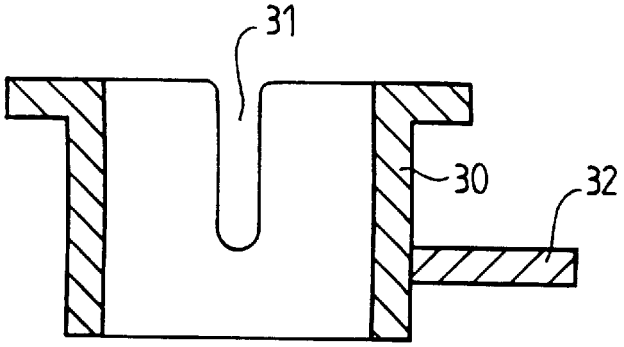
FIG. 3*a* represents a cross-sectional view of a nozzle support according to the invention.
Figure 3B:
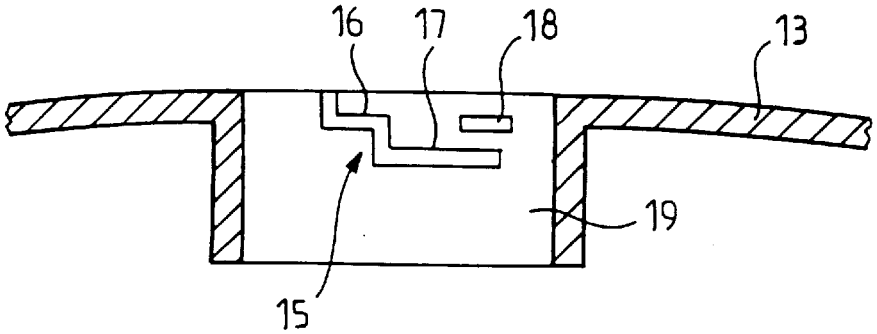
FIG. 3*b* represents a partial cross-sectional view of the housing of a vacuum cleaner according to the invention.

According to an additional variation of the device according to the invention and shown in FIGS. 3, 3*a* and 3*b*, this latter comprises a nozzle 20 furnished with at least one spur 22 on its periphery, a nozzle support 30 mounted to be movable in rotation on the housing 13 and comprising on the one hand at least one slot 31 in which is displaced the spur 22 and on the other hand a finger 32 cooperating with the driving means 10 of the control member 11, said spur 22 extending toward the exterior of the slot 31 in order to come to year on an abutment system 15 formed of a staircase having two levels 16, 17 to guide the locking of the nozzle 20 on the housing 13 by utilizing four distinct positions for the spur 22.

Figure 4:
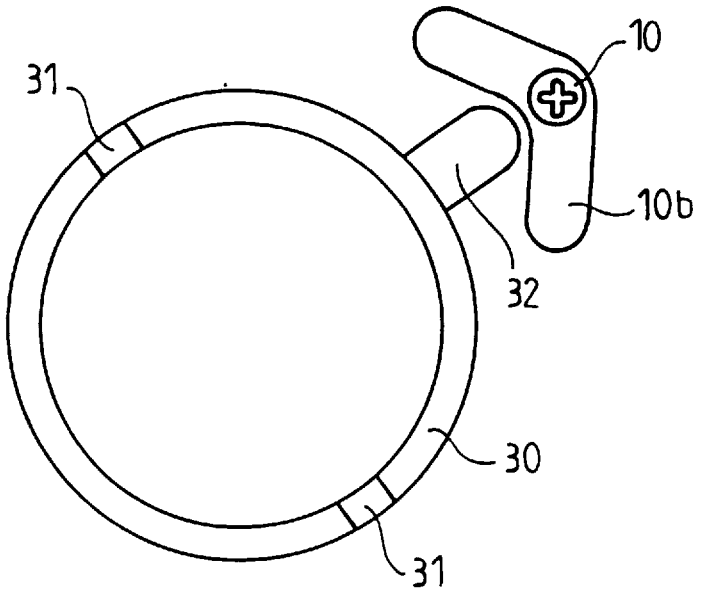
FIG. 4 is a top plan view of the duct support of FIG. 3A and according to the invention.

The driving means 10 cooperates with the finger 32 by the intermediary of a cam 10*b*, represented in FIG. 4 and arranged in a fixed manner on said driving means 10. The cam 10*b* is arranged on the driving means 10 in the free space situated between the housing 13 and the rigid zone 1*a*. Thus, the finger 32 causes rocking of the cam 10*b* during a rotation of the nozzle 20 corresponding either to a closing or to an opening of the bag I by the closing means.

FIG. 3*a* shows the nozzle support 30, furnished with the slot 31 in which is displaced the spur 22 and the finger 32 directing the control member 11.

FIG. 3*b* represents the abutment system 15 presenting two distinct levels 16 and 17 permitting the nozzle 20 to successively occupy several positions during the installation of the nozzle 20 on the nozzle support 30. The first position corresponds to a resting of the spur 22 on the first level 16 of the abutment system 15 after a first insertion El of the nozzle 20, the second position corresponding to a positioning of the spur 22 beyond the first level 16 after a first rotation RI in the extension plane of the first level 16, the third position corresponding to a resting of the spur 22 on the second level 17 after a second insertion E2, the fourth position corresponding to the locking of the spur 22 on the housing 13 after a second rotation R2 in the plane of extension of the second level 17. The abutment system 15, fixed to the housing 13 and extending to the neighborhood of the periphery of the nozzle support 30, presents levels 16 and 17 which extend sufficiently along an internal periphery 19 of the housing 13 in a manner to successively permit the opening of the bag 1 during the first rotation RI and the locking of the nozzle 20 on the housing 13 during the second rotation R2. In addition, the first insertion El permits the spur 22 to lodge in the slot 31 and the second insertion E2 corresponds to the introduction of the nozzle 20 into the bag 1 in a manner to traverse the waterproof membrane 3.

In this embodiment, the provision of means such as a lug 21 and an opening 11*b* is no longer indispensable.

Figure 3C:
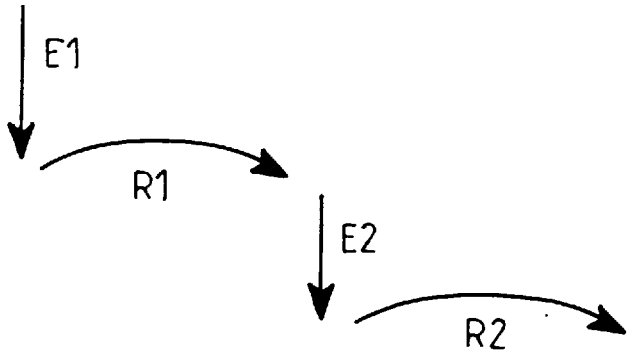
FIG. 3*c* represents an operating plan for locking of a nozzle on the vacuum cleaner housing.

FIG. 3*c* represents the functional diagram of the placement of the nozzle 20 on the housing 13. In showing the four successive locking steps including the first insertion E1, the first rotation R1, the second insertion E2 as well as the second rotation R2.

Advantageously, the device according to the invention comprises a boss 18 arranged on the housing 13 opposite the second level 17 of the abutment 15, said spur 22 is housed between the boss 18 and the second level 17 in the locking position of the nozzle 20 on the housing 13. Thus, the nozzle 20 cannot be separated from the housing 13. The unlocking or the disconnection of the nozzle 20 from the housing 13 is effectuated in a manner inverse to the locking by disengaging the spur 22 from the boss 18 against which the spur 22 bears in the locking position.

Thus, the means for cooperation permit actuating automatically the opening and the closure of the bag 1 with respectively the operation of locking and of unlocking of the nozzle 20 on the housing 13.

According to an advantageous embodiment of the device according to the invention, the opening 11*b* opens onto a free space in which is displaced a shaft not shown in the figures and fixed to the nozzle support 30 after the second insertion E2. Thus a face 11*c* is overhanging and provides an abutment for the shaft when the user exerts a pressure on the control member 11 when the nozzle 20 is locked onto the housing 13 corresponding to a position of an opening of the opening means of bag 1. This latter can then not be disconnected from the housing 13.

According to another embodiment of the device according to the invention, a complementary support can be arranged on the housing 13 preventing any translation of the control member 11 when the closing means of bag 1 is in the opening position.

According to another embodiment of the device according to the invention, the boss 18 is replaced by a ramp which is inclined with respect to the horizontal and arranged on the internal periphery 19 of the housing 13.

According to another embodiment of the device according to the invention, the abutment 15 is constituted by a profiled groove arranged in the housing 13. The spur 22 is thus displaced into the profiled groove and cannot in any manner be disengaged from said profiled groove as long as it is not in the first position corresponding to the first insertion El. The device thus conceived prevents the nozzle 20 from being disconnected from the housing 13 as long as the closing means or flap 5 of the bag 1 is not in its closed position.

Advantageously, the abutment system 15 of a device to the invention comprises a second abutment 15 symmetric with respect to the first in order to assure a better stability of the locked assembly, which is constituted by the nozzle 20 and the housing 13. In this embodiment, the abutment system 15 corresponds to a bayonet type system.

FIGS. 2, 3, 3*a*, 3*b*, 3*c* and 4 schematically show thus a device for connection between a vacuuming unit and a suction pipe, constituted by the nozzle 20, means for locking the nozzle 20 on the housing 13 as well as cooperation means permitting the nozzle 20 to cooperate with the control member 11, in such a manner that the locking of said nozzle 20 is possible when the flap 15 is in its opening position.

The functioning of the device according to the invention is illustrated in the following by the following operations. The user commences by fixing the bag 1 at the interior of the housing 13 by the intermediary of the edge 14 and of the slot 14*b*, in a fashion to engage the driving means 10 in the notch 5*d*. The user then causes the control member 11 to turn in a manner to position the flap 5 in its opening position. The nozzle 20 can then be fixed on the housing 13. When the bag 1 is filled, the user separates the nozzle 20 from the housing 13, turns the flap 5 into its closing position with the aid of the control member 11 and separates the part of the housing 13 on which the bag 1 is fixed from the rest of the suction unit. The user can then disconnect the bag 1 from the removable part of housing 13, for example over a trash receptacle, by a simple pressure on the control member 11.

Another functioning of the device according to the invention is obtained by another embodiment. The user fixes the bag 1 initially closed for example on the housing 13. Engagement of the nozzle 20 in the housing 13, by the intermediary of spurs 22 and of the nozzle support 30, and according to the respective movements EL, RI, E2 and R2, permits respectively to open the filling inlet of the bag 1 and to lock the nozzle 20 on the housing 13. When the user separates the nozzle 20 from the housing 13, the flap 5 of the bag 1 is automatically found in its closing position. The control member 11 is then utilized uniquely to separate the rigid part 1*a* from said housing 13, by a translation movement of the control member 11. A simplification could in this case be envisioned and this would consist in utilizing the driving means 10, associated with the cam 10*b*, as the control member 11 at the interior of the housing 13. The user should then separate the bag 1 from the housing 13 by its own means and nota1*b* lb 1*b* b a twisting of the rigid One advantage of the device according to the invention resides in the attainment of an automatic closing of the bag 1 by the unlocking of the nozzle 20 or by the action of the control member 11 directly by the user.

Another advantage of the device according to the invention is obtained by the absence of direct contact between the user and the bag 1 filled with dust after utilization of the vacuum cleaner. The ejection being effected by simple pressure on the control member 11.

A supplemental advantage of the bag 1 according to the invention resides in the realization of a closing system, comprising a flap 5 pivoting on the one hand and not having an axis of rotation for said flap 5.

POSSIBILITIES OF INDUSTRIAL APPLICATION

The invention finds its industrial application in the field of vacuum cleaners.

We claim:

1. A device for connecting a suction pipe to a vacuum cleaning unit and to a removable dust bag (1) for performance of a vacuuming operation, the cleaning unit having a housing (13) and a suction inlet, and the bag (1) having a filling opening (2*a*) and a flap (5), the flap (5) being carried by the bag (1) and being movable between an opening position in which the filling opening (2*a*) is unlocked and a closing position in which the filling opening is blocked, said device comprising:

an attachment nozzle (20) connected to form an extremity of the suction pipe;

means for temporarily securing the dust bag (1) to the housing (13) so that the filling opening (2*a*) is aligned with the suction inlet;

a control member (11) which is movable between a first position for placing the flap (5) in the opening position and a second position for placing the flap in the closing position when the dust bag (1) is secured to the cleaning unit; and cooperation means coupled to said control member for allowing said nozzle (20) to be locked in the suction inlet and to project past the flap only when said control member (11) is in the first position.

2. Device according to claim 1 wherein said cooperation means comprise male and female elements arranged on said control member (11) and on said nozzle (20), respectively, in a manner to cooperate when the flap (5) is in its opening position thus permitting locking off said nozzle (20) on the housing (13).

3. Device according to claim 1 wherein said control member (11) is mounted to movable in rotation to move the flap between the opening and closing positions, and to be movable in translation to separate the bag (1) from the housing (13).

4. Device according to claim 1 wherein said cooperation means comprise a lug (21) arrange on said nozzle (20) and an opening (11*b*) arranged in said control member (11), said lug in the opening (11*b*) during locking of said nozzle (20) on the housing (13).

5. Device according to claim 1 further comprising: at least one spur (22) carried by, an extending from the periphery of, said nozzle (20); a nozzle support (30) mounted to be movable by rotation on the housing (13),wherein said nozzle support (30) has at least one slot (31) in which said spur (22) is displaceable and a finger (32) cooperating with an opening (11*b*) arranged in said control member (11), said spur (22) extending out of the slot (31); and an abutment system (15) composed of steps having two levels (16, 17), said spur being movable between four distinct position relative to said abutment system while bearing on said abutment system in order to guide the locking of nozzle (20) on the housing (13).

6. Device according to claim 5 wherein a first position of said spur corresponds to a support of said spur (22) on a first level (16) of said abutment system (15) after a first insertion (E1) of said nozzle (20), a second position of said spur corresponds to a position of said spur (22) beyond the first level (16), after a first rotation (R1) in the plane of extension of the first level (16), a third position of said spur corresponds to a support of said spur (22) on a second level (17) after a second insertion (E2), and a fourth position of said spur corresponds to the locking of said spur (22) on the housing (13) after a second rotation (R2) in the plane of extension of the second level (17).

7. Device according to claim 6 further comprising a boss (18) arranged on the housing (13) facing the second level (17) of said abutment system (15), said spur (22) being housed between said boss (18) and the second level (17) to correspond to a position in which said nozzle (20) is locked in the suction inlet.

8. Device according to claim 5 wherein said abutment system (15) is constituted by a profiled groove arranged in the housing (13).

9. Device according to claim 1 wherein said device is mounted on the vacuum cleaning unit housing, and the housing contains vacuum cleaner components of the motor/ventilator type as well as the disposable bag (1).

10. A vacuum cleaner comprising:

a suction pipe;

a vacuum cleaning unit having a housing (13) and a suction inlet;

a removable dust bag (1) having a filling opening **(2*a*) and a flap (5), said flap (5) being by said bag (1) and being movable between an opening position in which said filling opening (2*a*)** is unlocked and a closing position in which said filling opening is blocked;

an attachment nozzle (20) connected to form an extremity of said suction pipe;

means for temporarily securing said dust (1) to said housing (13) so that said filling opening **(2*a*)** is aligned with said suction inlet;

a control member (11) which is movable between a first position for placing said flap (5) in the opening position and a second position for placing said flap in the closing position when said dust bag (1) is secured to said cleaning unit; and cooperation means coupled to said control member for allowing said nozzle (20) to be locked in said suction inlet and to project past said flap only when said control member (11) is in the first position.

11. The vacuum cleaner according to claim 10 wherein said bag (1) comprises a rigid member **(1*a*) located in the vicinity of said inlet opening of said bag (1) and containing said closing flap (5)**.

* * * * *